US005413983A

United States Patent [19]

Stern et al.

[11] Patent Number: 5,413,983

[45] Date of Patent: May 9, 1995

[54] MILLIMETER WAVE FERRITE SWITCH UTILIZING A SUPERCONDUCTING SWITCHING COIL

[75] Inventors: Richard A. Stern, Allenwood; Richard W. Babbitt, Fair Haven; Thomas E. Koscica, Clark, all of N.J.

[73] Assignee: The United States of America as represented by the Secretary of the Army, Washington, D.C.

[21] Appl. No.: 104,312

[22] Filed: Aug. 10, 1993

[51] Int. Cl.[6] ..... H01P 1/11; H01P 1/175

[52] U.S. Cl. ..... 505/211; 505/210; 505/700; 505/866; 505/879; 333/99 S; 333/24.3; 333/258; 335/216; 336/DIG. 1

[58] Field of Search ..... 333/99 S, 24.3, 258; 505/1, 700, 701, 866, 879, 210, 204, 211; 335/216; 336/DIG. 1

[56] References Cited

U.S. PATENT DOCUMENTS

| | | | |
|---|---|---|---|
| 2,719,274 | 9/1955 | Luhrs | 333/24.3 |
| 2,908,878 | 10/1959 | Sullivan et al. | 333/24.3 X |
| 4,843,357 | 6/1989 | Stern et al. | 333/258 |
| 4,933,317 | 6/1990 | Johnson, Jr. et al. | 505/1 |

*Primary Examiner*—Benny T. Lee

*Attorney, Agent, or Firm*—Michael Zelenka; William H. Anderson

[57] ABSTRACT

A tetrahedral junction waveguide switch having a first length of hollow rectangular waveguide and a second length of hollow rectangular waveguide adjacent each other with a ferrite rod longitudinally disposed therebetween. A magnetic field is created by a superconducting switching coil placed around the junction of the two lengths of waveguide. The normally magnetically biased ferrite rod permits electromagnetic wave energy to be transmitted through the first and second lengths of waveguide. An open circuit control means selectively and controllably interrupts the current flowing around the superconducting switching coil causing the longitudinal magnetic field to be removed from the normally magnetically biased ferrite rod. The waveguide switch is thereby placed in a cut off, nontransmission, or reflective mode preventing transmission of electromagnetic wave energy. The waveguide switch of the present invention has reduced size and weight and improved switching speed than that of prior waveguide switching devices.

3 Claims, 2 Drawing Sheets

MILLIMETER WAVE FERRITE SWITCH UTILIZING A SUPERCONDUCTING SWITCHING COIL

STATEMENT OF GOVERNMENT RIGHTS

The invention described herein may be manufactured, used and licensed by and for the government for governmental purposes without the payment to us of any royalties thereon.

FIELD OF THE INVENTION

This invention relates generally to a waveguide switch for selectively transmitting millimeter wave energy, and more particularly to a tetrahedral junction type waveguide switch for use in various communication devices, including radar.

BACKGROUND OF THE INVENTION

Tetrahedral junction waveguide switches are used in many millimeter wave applications. One such switch is disclosed in U.S. Pat. No. 4,843,357 entitled "Tetrahedral Junction Waveguide Switch" issuing to Stern et al on Jun. 27, 1989, which is herein incorporated by reference. Therein disclosed is a waveguide switch employing two lengths of waveguides for transmitting electromagnetic energy joined by a tapered rod of ferrite material. The two waveguides each have a major transverse axis. The major transverse axes of each of the two waveguides are made orthogonal. At their junction, the ferrite rod is positioned thereat. The rod's longitudinal axis coincides with the longitudinal axis of the two joined waveguides. A longitudinal magnetic field is applied to the ferrite rod by a permanent magnet structure. As a result of the well known Reggia-Spencer effect, when the ferrite rod is subjected to a unidirectional magnetic field along its longitudinal axis, the permeability of the rod is changed permitting electromagnetic wave energy to pass through the aperture adjoining the two waveguides. Therefore, the permanent magnet provides a magnetic field that biases the switch permitting electromagnetic wave energy or a signal to pass through the waveguide junction.

In some applications, it is desirable to prevent or cut off electromagnetic wave energy from being transmitted through the waveguide. For example, this is commonly done to protect a radar receiver during the duration of the radar transmitting pulse. However, when the radar echo is received, the waveguide must be in a state to transmit the substantial reduced electromagnetic wave energy echo signal. In order to place the waveguide switch in a cut off or non-transmission state, the longitudinal magnetic field must be removed from the ferrite rod. This is accomplished by a helical coil circumscribing the waveguide junction and ferrite rod. Therefore, when the waveguide switch is to be placed in a non-transmission state or mode, the appropriate current is applied to the helical coil resulting in another longitudinal magnetic field opposing that of the longitudinal magnetic field created by the permanent magnet. Therefore, no net longitudinal magnetic field is applied to the ferrite rod resulting in the prevention of electromagnetic wave energy from being transmitted through the waveguide switch.

While the prior art waveguide switches have performed adequately in many applications, there remain several disadvantages. The permanent magnetic structures and the required helical coil results in a relatively heavy and bulky or large waveguide switch. Additionally, the necessity to use a generated magnetic field to oppose the magnetic field of the permanent magnet results, over a period of time, in the compromising of the performance of the permanent magnet structure. Additionally, the necessity to balance the two opposing magnetic fields to provide a non-transmission state of the waveguide results in additional controls being required. This is especially true as the properties of the permanent magnetic material and thereby resulting magnetic field may change in time. With many of the applications of a waveguide switch being used in aircraft, there is a continuing need to reduce the size, weight, and energy requirements of a waveguide switch.

SUMMARY OF THE INVENTION

The present invention is a tetrahedral junction type waveguide switch especially applicable to millimeter wave radar systems. A first length of hollow rectangular waveguide and a second length of hollow rectangular waveguide are coupled by a ferrite rod. The longitudinal axes of the first and second length of waveguides are aligned together with the longitudinal axis of the ferrite rod. A unidirectional longitudinal magnetic field is applied to the ferrite rod by a superconducting coil. The continuous current of the superconducting coil maintains the longitudinal magnetic field, resulting in the coupled first length and second lengths of waveguide freely transmitting the electromagnetic wave energy therethrough. An open circuit control means is coupled to the superconducting coil circumscribing the ferrite rod. The open circuit control means selectively and controllably prevents current from flowing around the superconducting coil circumscribing the ferrite rod. As a result, the longitudinal magnetic field is eliminated from the interior of the superconducting coil and the ferrite rod is no longer affected. Therefore, electromagnetic wave energy is prevented from traveling between the first and second lengths of the rectangular waveguides.

Accordingly, it is an object of the present invention to improve the operation of tetrahedral junction type waveguide switches while reducing their size and weight.

It is an advantage of the present invention that a reduction in electrical power requirements is achieved.

It is a feature of the present invention that a superconducting coil is used together with an open circuit control means.

These and other objects, advantages, and features will become more readily apparent in view of the following more detailed description.

DETAILED DESCRIPTION OF THE PREFERRED EMBODIMENT

Figure 1:
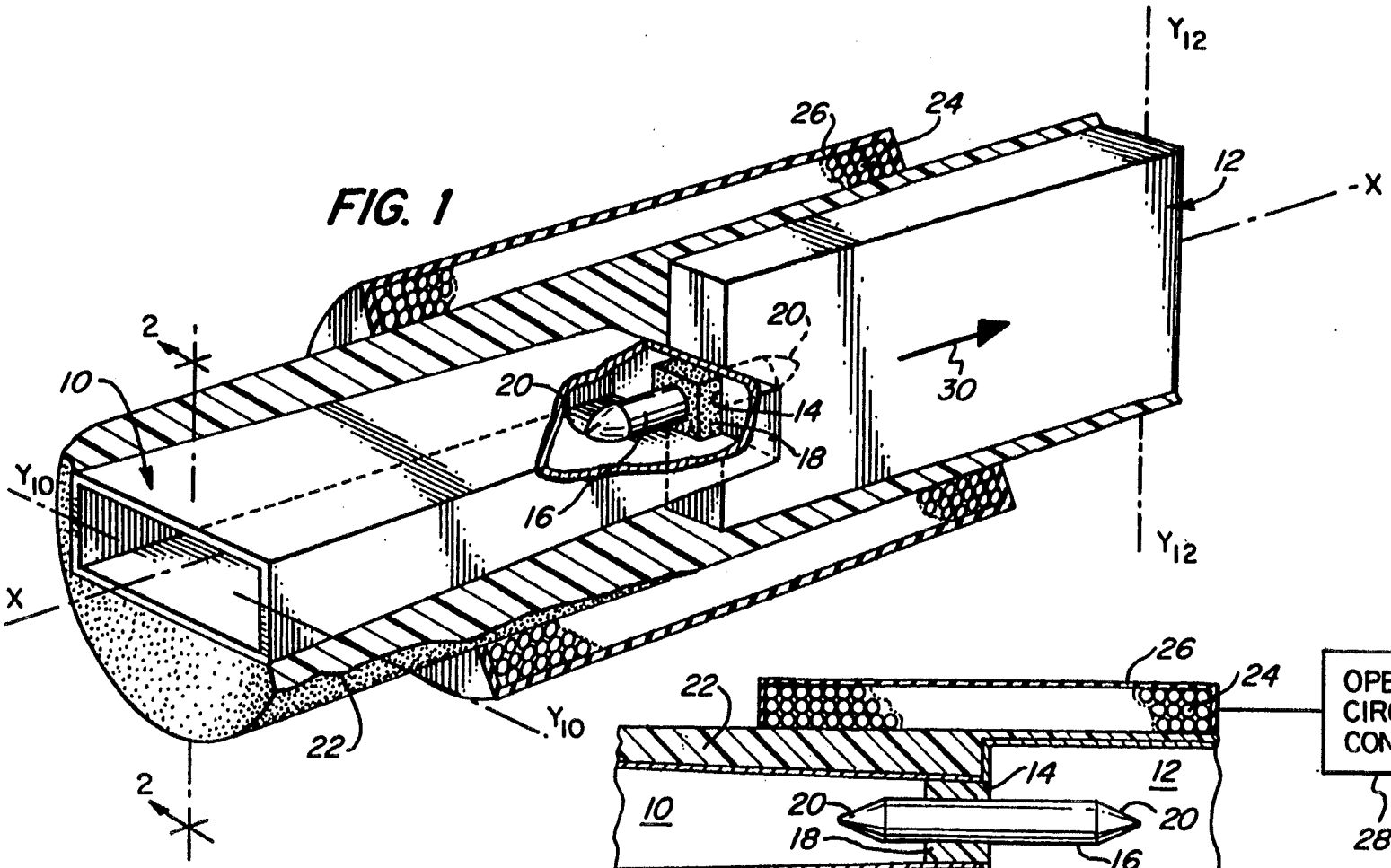
FIG. 1 is a perspective view of the waveguide switch of the present invention.
Figure 2:
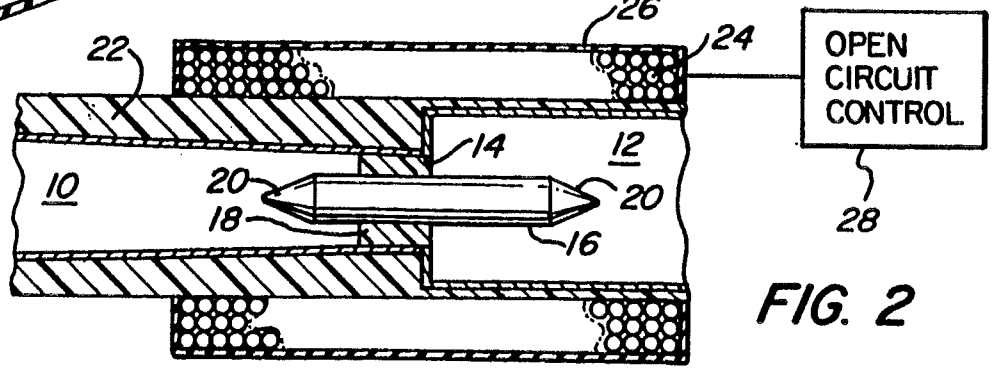
FIG. 2 is a longitudinal cross section taken along line 2—2 in FIG. 1.

In FIGS. 1 and 2, the present invention is generally illustrated. A first length of hollow rectangular waveguide 10 is coupled to a second length of hollow rectangular waveguide 12. The first length of waveguide 10 has a major transverse axis $Y_{10}$–$Y_{10}$ (See FIG. 1). The second length of waveguide 12 has a major transverse axis $Y_{12}$–$Y_{12}$ (See FIG. 1). The first length of waveguide 10 and the second length of waveguide 12 are positioned such that the major transverse axes are orthogonal. Both of the waveguide lengths 10 and 12 are tapered along their longitudinal axis having their smaller ends at the point of coupling. A square aperture 14 is formed at the point of coupling. Placed within this square aperture 14 is a ferrite rod 16. Ferrite rod 16 is held within the square aperture 14 by support 18. Support 18 may be made of any material that exhibits a low loss transmission characteristic at the intended frequency of operation. Teflon is a material that exhibits low transmission loss at millimeter wave frequencies. The ferrite rod 16 has tapered ends 20. The longitudinal axis of the ferrite rod is parallel to the longitudinal axis of the first and second lengths of waveguides 10 and 12. The first and second length of waveguides 10 and 12 are held in position by mounting means 22. Circumscribing the mounting means 22 and positioned around the ferrite rod 16 is a superconducting coil 24. Cover 26 covers superconducting coil 24. As illustrated in FIG. 2, open circuit control means 28 is attached to the superconducting coil 24. The open circuit control means 28 performs the function of selectively and controllably diverting or preventing current to flew around the superconducting coil 24 resulting in the internal longitudinal magnetic field being eliminated or substantially reduced. The superconducting coil 24 can be made of any supercot.-ducting material. The term superconducting material means any material having the property that at a predetermined temperature electrical resistivity thereof vanishes or becomes very small.

Figure 3:
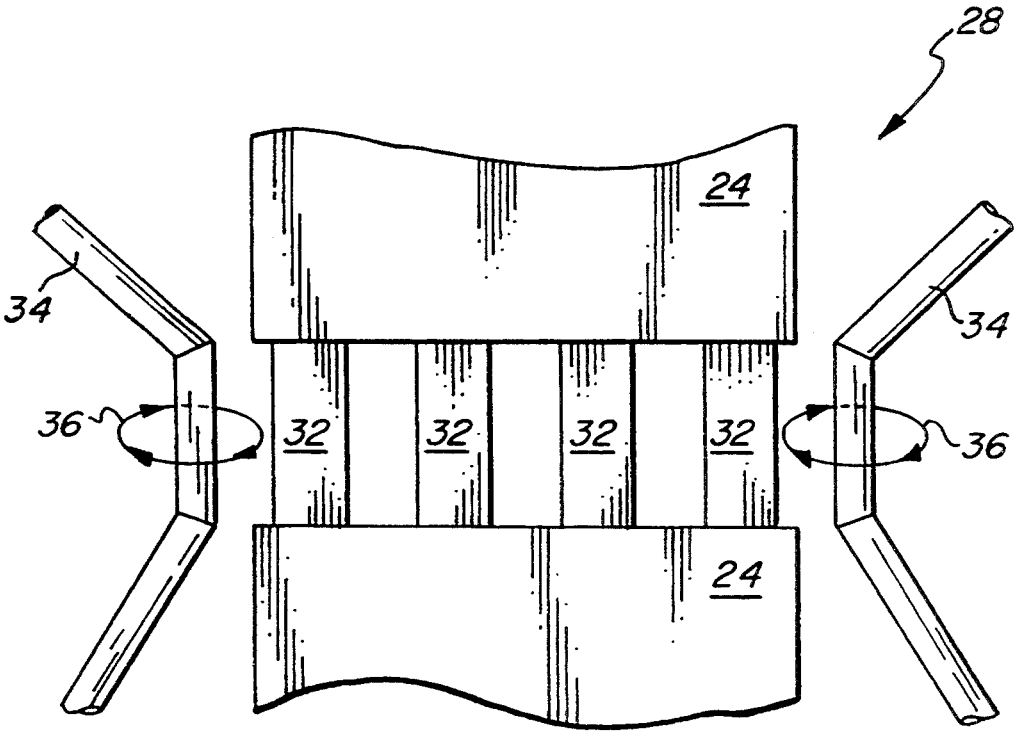
FIG. 3 is a top plan view of one embodiment of an open circuit control means.

FIG. 3 illustrates one embodiment of the open circuit control means 28. A portion of the superconducting coil 24 is separated by a plurality of weak links 32. The weak links 32 are made of the same material as the superconducting coil, but have a reduced dimension. Adjacent each side of the plurality of weak links 32 is a control line 34. The control lines 34 carry a controllable current which induces a magnetic field represented by arrows 36. The magnetic field influences the plurality of weak links 32 causing the weak links 32 to lose their superconducting property, resulting in an effective open circuit. This prevents current from flowing around the superconducting coil 24. Upon removal of the influencing magnetic field current flow around the superconducting coil 24 is resumed.

In operation, with reference to FIGS. 1 and 2, when the superconducting coil 24 is energized, a constant current is caused to flow around the coil 24. No continuous power is required to be applied to the superconducting coil 24 once a constant current flow is established. As a result of the constant current flowing in the superconducting coil, a unidirectional magnetic field having a orientation as indicated by arrow 30 is applied along the longitudinal axis X—X of the ferrite rod 16 as shown in FIG. 1. The gyromagnetic properties of the ferrite material cause the electromagnetic wave energy applied to the rod by one of the lengths of waveguides 10 or 12 to be rotated 90 degrees so that the electromagnetic wave energy passes through the square aperture 14 to the other length of waveguide 10 or 12. Therefore, when the superconducting coil 24 is energized and conducting a current therethrough, the waveguide switch transmits the electromagnetic wave energy from one length of waveguide 10 or 12 the other length of waveguide 10 or 12. The switch is bidirectional, and when in the transmission state will transmit electromagnetic wave energy in either direction. When the waveguide switch is desired to be placed in the cutoff, nontransmission, or reflective mode so as not to transmit wave energy therethrough, the open circuit control means 28 interrupts the current flow in the superconducting coil 24 by creating an open circuit. The magnetic field represented by arrow 30 thereby quickly dissipates, placing the waveguide switch in the cutoff, non-transmission, or reflective mode. Therefore, electromagnetic wave energy does not flow therethrough. The ability to switch the current flowing around the superconducting coil 24 on and off translates into a high speed switching capability for the waveguide switch of the present invention. This high speed switching capability is in the order of a nanosecond.

Therefore, it should readily be appreciated in view of the above disclosure that the present invention greatly advances waveguide switching. The present invention makes possible reduction in size and weight while allowing for faster switching speeds than are presently possible. Additionally, the present invention requires less power than conventional waveguide switches.

Although the preferred embodiment has been illustrated and described, it will be obvious to those skilled in the art that various modifications may be made without departing from the spirit and scope of this invention.

What is claimed is:

1. A tetrahedral junction waveguide switch comprising:

a first hollow rectangular waveguide tapered along a first longitudinal axis and having a first end and a first transverse axis;

a second hollow rectangular waveguide tapered along a second longitudinal axis and having a second end and a Second transverse axis, wherein the first and second waveguides are positioned such that the first and second ends are adjacent each other and define a common aperture and such that the first and second transverse axes of the first and second waveguides are orthogonal;

a ferrite rod having tapered ends mounted in said common aperture, said ferrite rod having a longitudinal axis aligned with the first and second longitudinal axes of said first and second waveguides, said ferrite rod respectively cooperating with said first and second ends of said first and second waveguides;

a superconducting coil comprised of superconducting material encircling said ferrite rod;

open circuit control means, coupled to said superconducting coil, for selectively and controllably creating an open circuit in said superconducting coil, the open circuit control means comprising superconducting weak links in said superconducting coil, a control line disposed adjacent to the superconducting weak links, and means to supply a control voltage to the control line;

means to generate electromagnetic wave energy electrically connected to the first waveguide; and means to provide a current flow connected to said superconducting coil;

wherein said generated electromagnetic wave energy is applied to said first waveguide and propagates through said aperture from said first waveguide to said second waveguide when a unidirectional magnetic field is applied along the longitudinal axis of said ferrite rod by providing the current flow through said superconducting coil and wherein said propagation of the electromagnetic wave energy is stopped when the magnetic field is not applied to said ferrite rod by interrupting the current flow around said superconducting coil by applying the control voltage to the control line thereby causing the superconducting weak links to be non-superconducting and thereby ceasing the current flow in said superconducting coil and removing the unidirectional longitudinal magnetic field applied to the longitudinal axis of said ferrite rod.

2. A tetrahedral junction waveguide switch as in claim 1 further comprising:

a support attached to said ferrite rod and one of said first and second waveguides.

3. A tetrahedral junction waveguide switch as in claim 2 wherein:

said support is comprised of a material that has a low loss transmission characteristic at a desired frequency of operation.

* * * * *